US008092109B2

(12) United States Patent
Dieudonat et al.

(10) Patent No.: US 8,092,109 B2
(45) Date of Patent: Jan. 10, 2012

(54) APPLICATOR DISTRIBUTOR OF A PASTY PRODUCT

(75) Inventors: Fabrice Dieudonat, Fosses (FR); Alain Berhault, Paris (FR)

(73) Assignee: Albea Services (FR)

( * ) Notice: Subject to any disclaimer, the term of this patent is extended or adjusted under 35 U.S.C. 154(b) by 1440 days.

(21) Appl. No.: 11/556,034

(22) Filed: Nov. 2, 2006

(65) Prior Publication Data

US 2007/0098484 A1 May 3, 2007

(30) Foreign Application Priority Data

Nov. 3, 2005 (FR) ..... 05 11191

(51) Int. Cl.
*A47L 13/30* (2006.01)

(52) U.S. Cl. ..... 401/263

(58) Field of Classification Search ..... 401/265, 401/266, 261–264, 269–273
See application file for complete search history.

(56) References Cited

U.S. PATENT DOCUMENTS 2,048,689 A * 7/1936 Feasel ..... 401/205
3,029,001 A 12/1959 Blish
3,390,940 A * 7/1968 Schwartzman ..... 401/186
4,368,746 A * 1/1983 Spatz ..... 401/202
5,476,198 A 12/1995 Jouillat et al.
6,773,193 B2 * 8/2004 Delage ..... 401/205
2001/0031171 A1 10/2001 Delage
2003/0116589 A1 6/2003 De Laforcade

* cited by examiner

*Primary Examiner* — Huyen Le
(74) *Attorney, Agent, or Firm* — Banner & Witcoff, Ltd.

(57) ABSTRACT

Aspects of the invention disclose an applicator distributor of a pasty product that flows by gravity, the applicator distributor comprising a body comprising a main reservoir for said product, a distribution head comprising at least one orifice and a removable cap. The cap forms a means for vertically placing the applicator distributor, and wherein the applicator distributor is a downward-facing applicator distributor, so that the product can flow by gravity to the head, and wherein, the head comprises: a peripheral member forming a means of attachment to said reservoir, a central member comprising a central arch obstructing said main opening and comprising a portion forming an application surface of said product, and at least one flexible element that can be deformed under an axial strain, and can form a secondary reservoir that can house a dose of said product, and that can be filled when said applicator distributor is facing downwards.

22 Claims, 8 Drawing Sheets

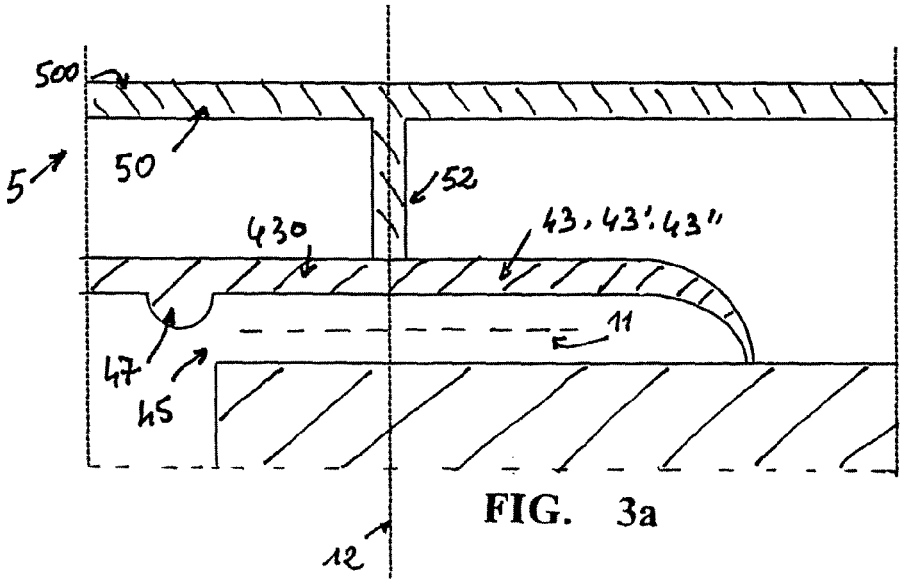
FIG. 3a
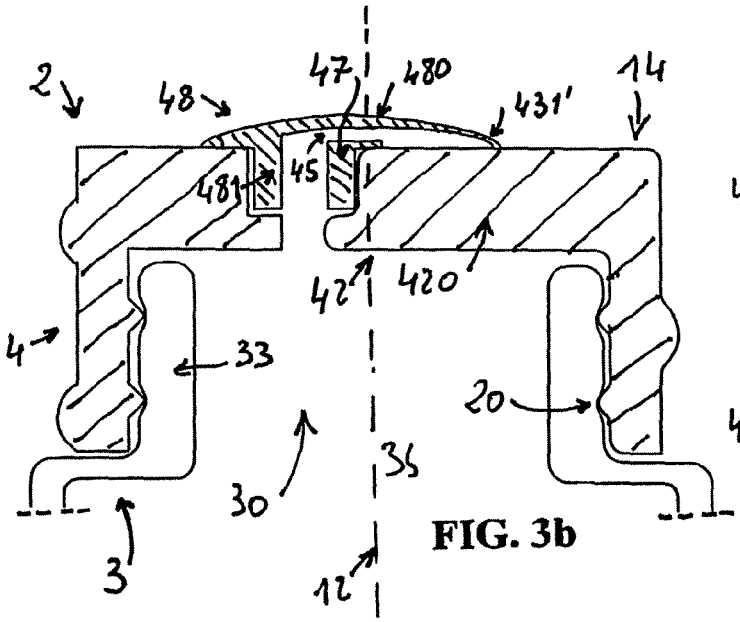
FIG. 3b
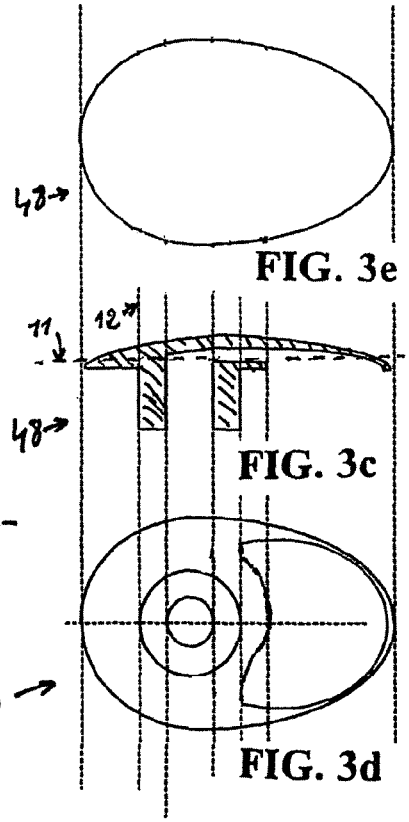
FIG. 3e
FIG. 3c
FIG. 3d

APPLICATOR DISTRIBUTOR OF A PASTY PRODUCT

FIELD OF THE INVENTION

The invention relates to the field of distributors of cosmetic products and typically cosmetic products with a pasty or viscous consistency, for example creams or gels. The invention also relates to cosmetic products that can flow by gravity, such as creams for example.

BACKGROUND OF THE INVENTION

Many cosmetic products are generally distributed in jars. Classic jars are known that comprise a body forming a cavity designed to contain said cosmetic product with an upper opening that may be closed by sealing means. Generally, the sealing means is a lid or a cap that can be screwed onto said body.

In addition, containers are known that are equipped with a distributing pump that can distribute products of liquid or pasty consistency. Tubes also are known that are used to contain products of liquid or pasty consistency.

Many traditional jars used for cosmetic products require fingers to be used as the means of application, which is not a particularly advantageous method of application and use from a hygiene point of view. Also for hygiene reasons, it is often necessary to limit exposure of the packaged product to air.

Furthermore, it is advantageous to have a product distributor comprising an integrated means of applying said product to the skin, so that said distributor also forms an applicator of said cosmetic product.

Furthermore, the formulations of the cosmetic products can change constantly. Certain cosmetic compositions comprising at least one volatile constituent are being developed. It is important to have a distributor suited to these new formulations.

Moreover, in the case of cosmetic products that can flow by gravity, it can be important to have packaging that allows the rheological properties of said product to be maintained throughout its life. Finally, it can be necessary to renew the packaging of cosmetic products, especially when the products themselves are renewed, in order to draw the attention of the users of said cosmetic products and thus favor their purchase, without forsaking, for obvious financial reasons, the need for distributors that are easy to assemble or which comprise a limited number of separate parts.

SUMMARY OF PREFERRED EMBODIMENTS OF THE INVENTION

In aspects of the invention, an applicator distributor of a pasty (i.e., pasty, thick or viscous) product, includes a body comprising a main reservoir for said product equipped with a main opening, a distribution head for said product, attached to said main reservoir, comprising at least one distribution orifice for said product, and a removable cap cooperating with said body. The pasty product may be a cosmetic or hygiene product that can flow by gravity and which can be designed to be spread, when said product is applied to a part of the human body, typically on the skin, such as on the face.

In aspects of the invention, the distribution head of the applicator distributor can comprise: 1) a peripheral member forming a means of attachment to the main reservoir of the body of the applicator distributor so that the distribution head covers the main opening, 2) a central member comprising a central arch obstructing the main opening and comprising a part forming an application surface for the product, and 3) at least one flexible element that may be deformed under an axial strain, the flexible member cooperating with the central arch by forming a secondary reservoir that can house one dose of the pasty product. The secondary reservoir can be filled when the applicator distributor is pointed facing downwards, the pasty product thereby flowing by gravity from the main reservoir situated above the secondary reservoir by a so-called upstream means of communication. When axial strain is exerted on the flexible member, the upstream orifice is obstructed, the capacity of said secondary reservoir is reduced, and the capacity changes from a maximum capacity $C_M$ to a minimum capacity $C_m$. Consequently a dose of the pasty product is expulsed towards said application surface by a so-called downstream means of communication.

In aspects of the invention, the applicator distributor of the invention can (1) avoid the fingers as application means, so that it is advantageous from a hygiene point of view, (2) make it possible to limit the contact between the packaged product and the atmospheric air, which is increasingly dust filled, (3) incorporate an application means of the product to the skin, so that the distributor also forms an applicator of said cosmetic product, (4) offer possibilities of adapting to the new cosmetic compositions that comprise at least one volatile constituent, (5) ensure that the rheological properties of said product last for substantially its entire life, by considerably reducing the risks of evaporation, which is important for cosmetic products that flow by gravity, (6) make it possible to renew the packaging of cosmetic products, which is important from a marketing point of view.

Embodiments of the invention allow problems in prior art devices to be overcome. Embodiments of the invention also make it possible to economically form means to obtain predetermined dosed quantities without requiring a dosing pump. Embodiments of the invention also permit the dispensing of N possible doses substantially simultaneously, which may be very advantageous in practice.

BRIEF DESCRIPTION OF THE DRAWINGS

All of the figures relate to embodiments of aspects of the invention.

Figure 1A:
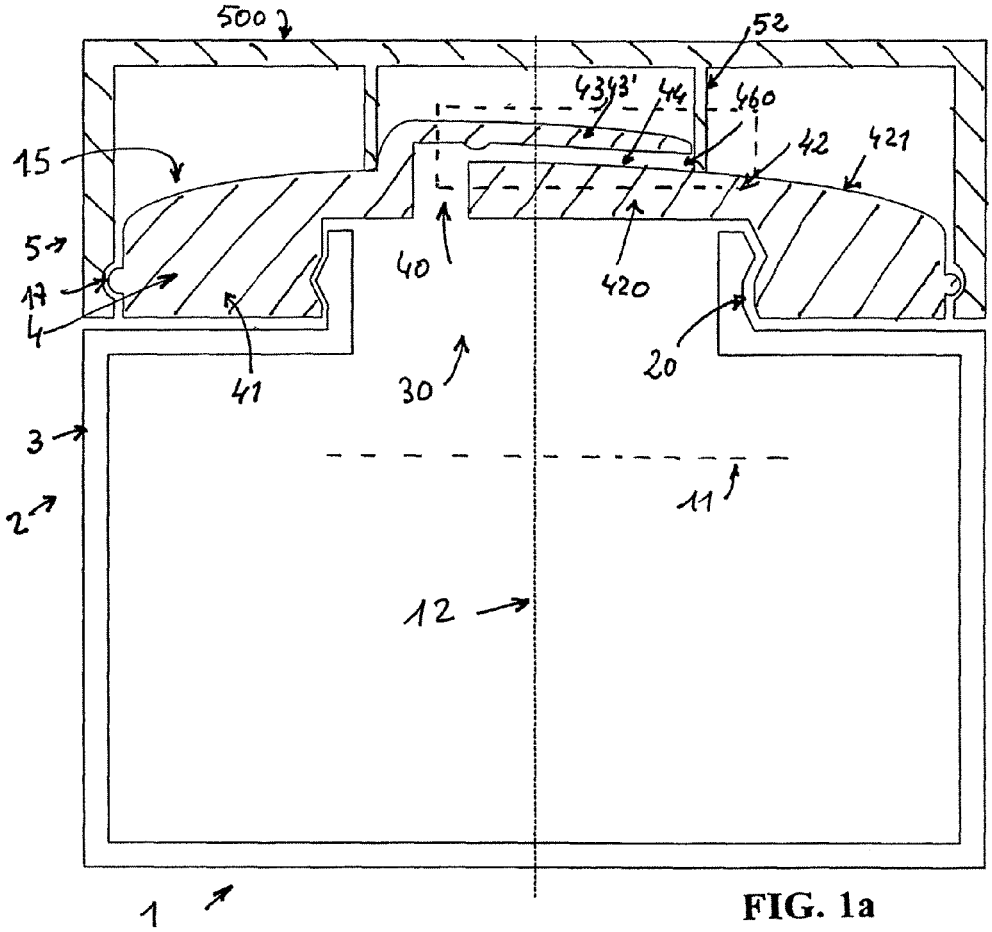
FIG. 1*a* is an axial cross section in the axial direction (12) of a closed applicator distributor (1, 1') shown "facing upwards", the cap (5) cooperating with the body (2) by cooperation means (17), such as a screw thread or an axial clip. The body (2) comprises a reservoir (3) for the product (6), shown without hatching, cooperating with a distribution head (4) via cooperation means (20), such as a screw thread or an axial clip.
Figure 1B:
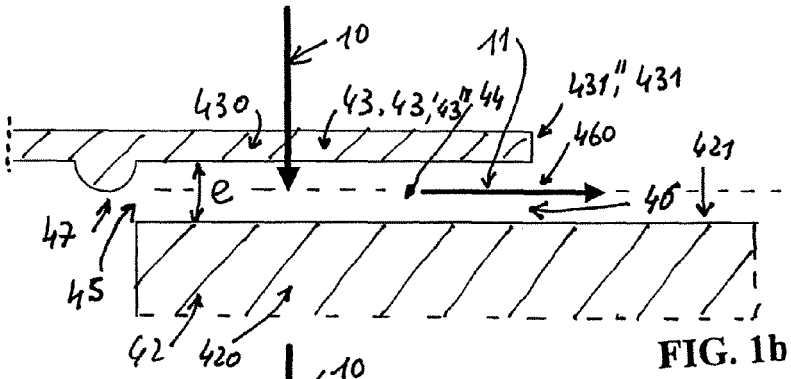
FIGS. 1*b* and 1*c* are partial axial cross sections illustrating variants of the portion surrounded by a rectangle in dotted lines in FIG. 1*a* after separation from the cap (5). In these variants, the flexible member (4) forms a resilient flexible strip (43') that may be compressed against the central arch (420) of the central member (42) under the action of an axial strain (10) shown by an axial arrow in FIGS. 1*b* and 1*c*, and that can return to its initial position at rest, as shown in FIGS. 1*b* and 1*c*, as soon as said axial strain (10) ceases.

In the variant of FIG. 1*b*, the peripheral part (431) of the flexible member (43) forms a free lip (431").

Figure 1C:
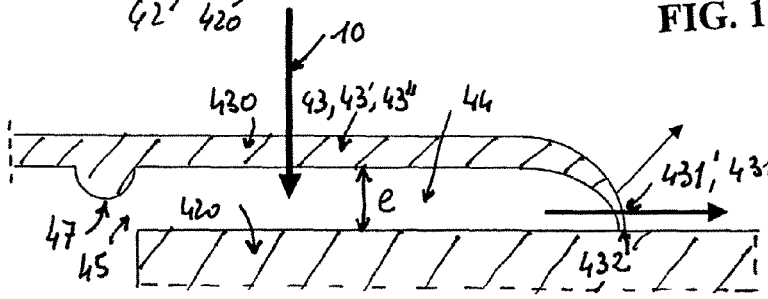

In the variant of FIG. 1*c*, the peripheral part (431) of the flexible member (43) forms a contact lip (431') whose end (432) is in contact with said central arch (420), even in the absence of said axial strain (10).

Figure 2A:
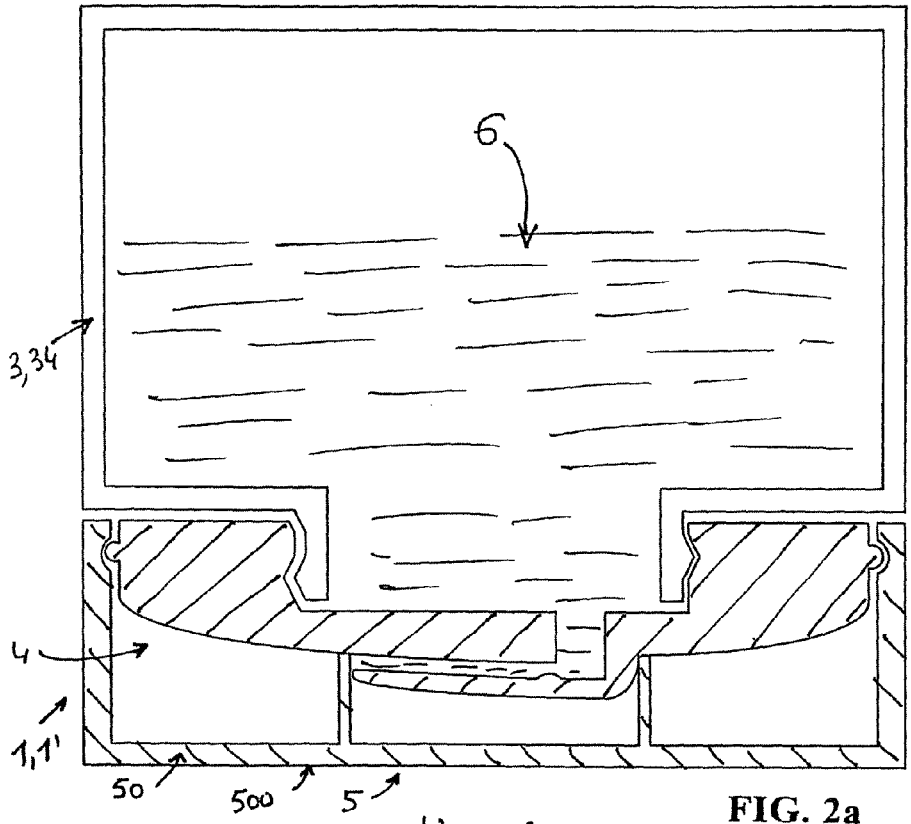

FIG. 2*a*, shows the distributor (1) closed and pointed "facing downwards" so as to allow said product (6) to flow by gravity towards the distribution head (4).

Figure 2B:
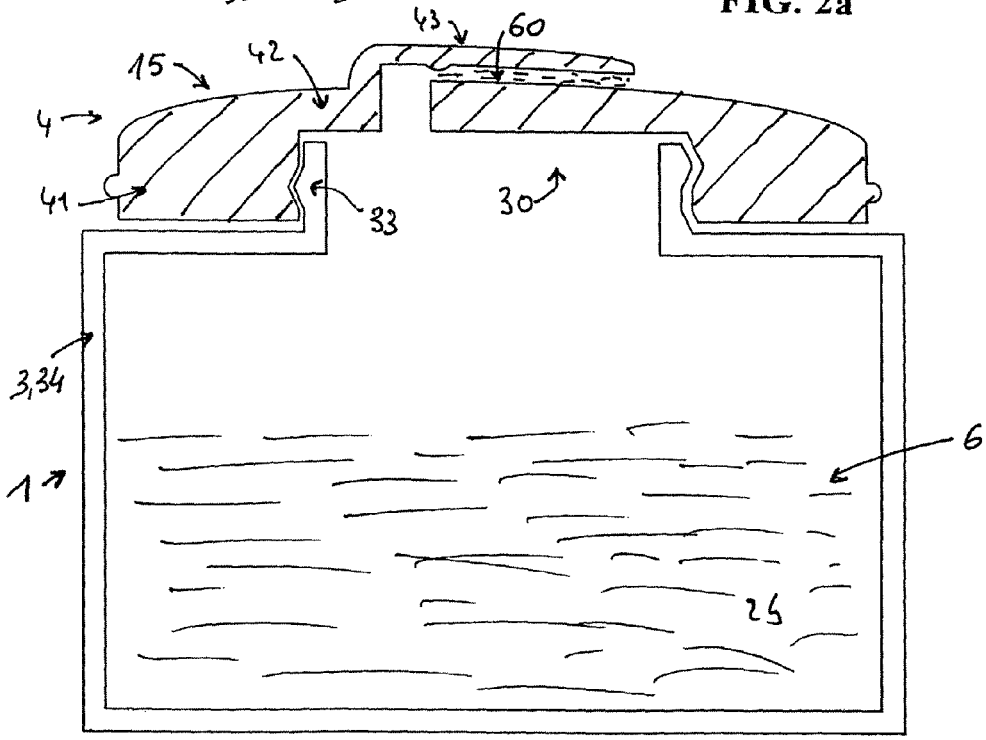

FIG. 2*b* shows the body (2) of the distributor (1) of FIG. 2*a*, pointed "facing upwards" ready to be used, wherein the distributor is open after separation from cap (5). In the distribution head (4) is thus located a dose of the product (60) ready to be applied.

FIG. 3*a* is analogous to FIG. 1*c* and illustrates the axial locking of the flexible member (43, 43', 43") by axial projection (52) of the cap (5) when the cap (5) cooperates with the body (2), wherein the applicator distributor (1, 1') is closed.

FIGS. 3*b* to 3*e* illustrate the case where the flexible member (43) of the distribution head (4) forms a separate part (48), typically a molded part made of elastomer, comprising a foot (481) that can be clipped onto the central member (42), and an arch (480) forming said resilient flexible strip (43').

FIG. 3*b* is a cross sectional view in the axial direction (12) of the distribution head (4) cooperating with the spout (33) of the reservoir (3).

FIGS. 3*c* to 3*e* relate to said separate part (48).

FIG. 3*c* is a cross section in the axial direction (12).

FIG. 3*d* is a top view.

FIG. 3*e* is a view from below.

Figure 4A:
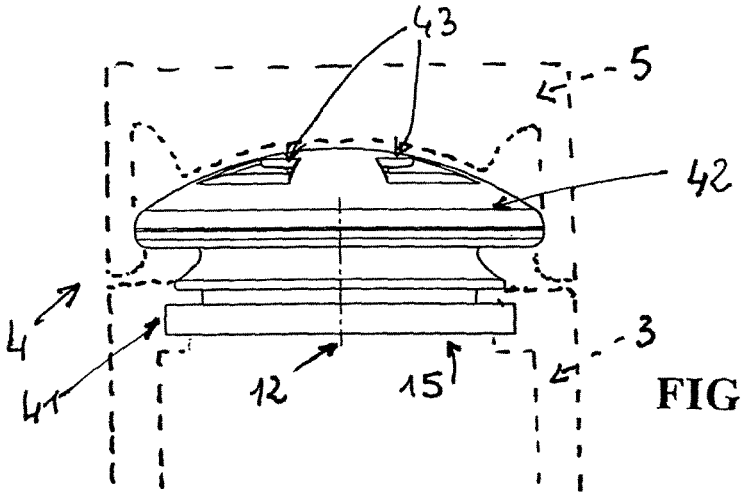
Figure 4B:
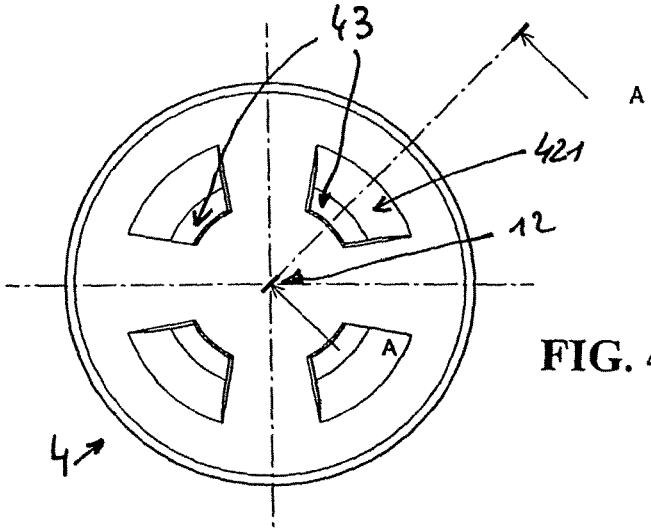
Figure 4C:
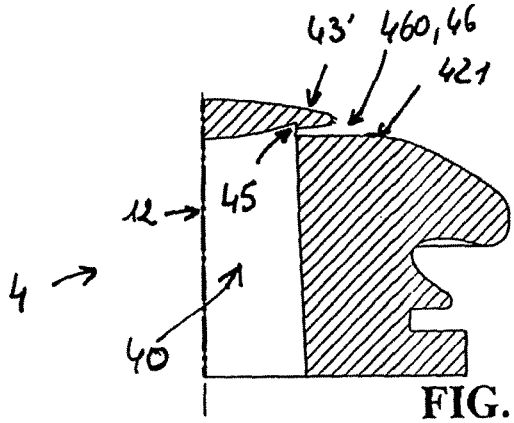

FIGS. 4*a*-4*c* relate to a distribution head (4) comprising 4 flexible elements (43) and 4 secondary reservoirs (44) located at 90° to one another with respect to said axial direction (12).

FIG. 4*a* is a side view of the distribution head (4). In this figure, the cap (5) and the reservoir (3) are shown in dotted lines.

FIG. 4*b* is a top view.

FIG. 4*c* is a partial cross section in the axial plan A-A of FIG. 4*b*.

Figure 5A:
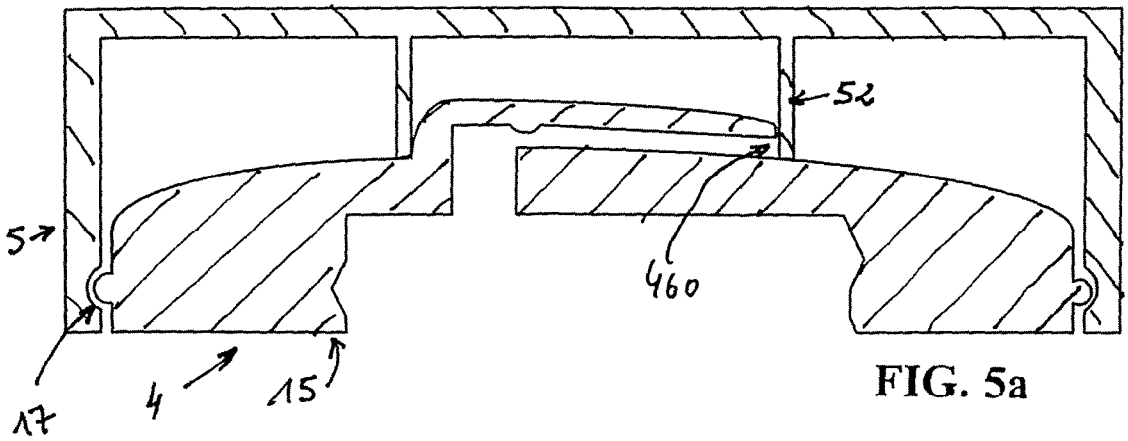
Figure 5B:
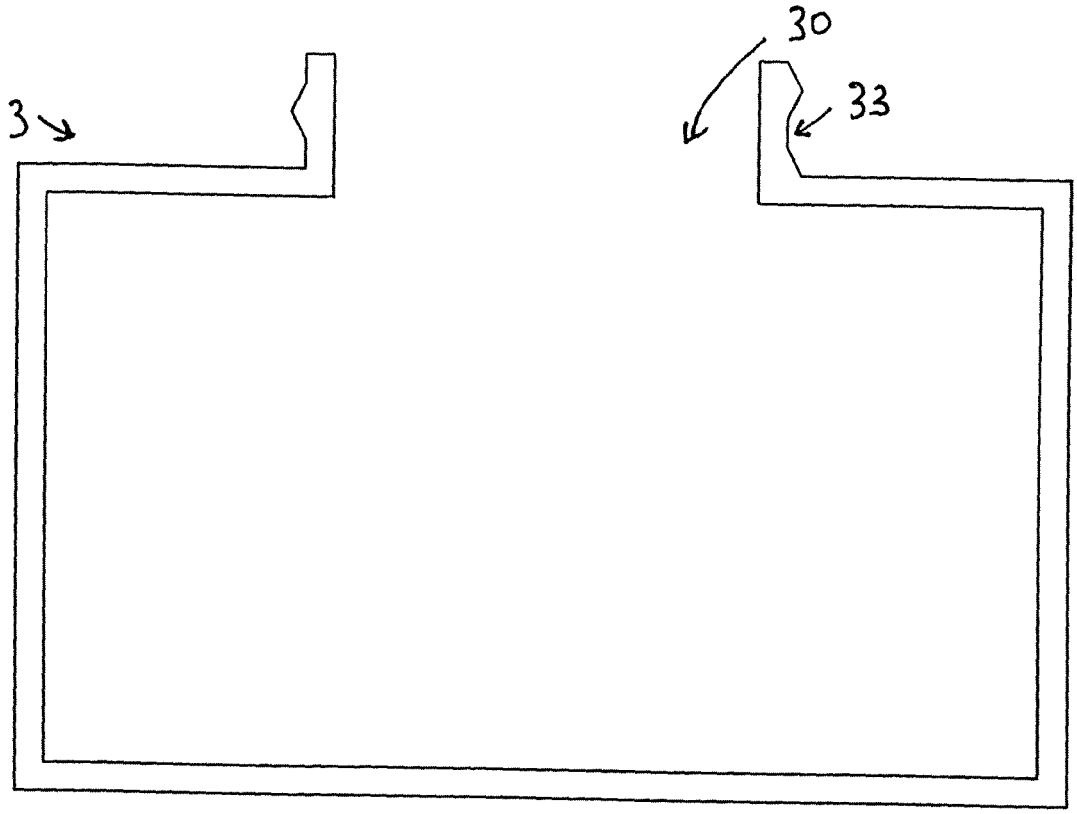

FIGS. 5*a* and 5*b* are axial cross sectional views which illustrate the filling of the applicator distributor (1, 1') of FIG. 1*a*.

FIG. 5*a* shows the cap (5) cooperating with the distribution head (4) via the cooperation means (17), wherein this assembly is shown opposite the reservoir (3) of FIG. 5*b*, ready to be filled.

Figure 5C:
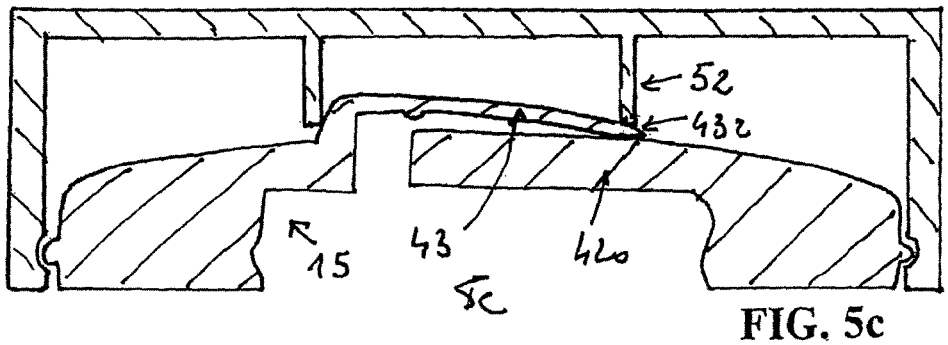

FIG. 5*c* is analogous to FIG. 5*a* and illustrates a valiant in which the projection (52), instead of obstructing the downstream orifice (460) as shown in FIG. 5*a*, exerts an axial strain on the end (432) of the flexible member (43) and presses this end against the central arch (420), so as to obstruct said downstream means of communication (46) and said downstream orifice (460).

Figure 6A:
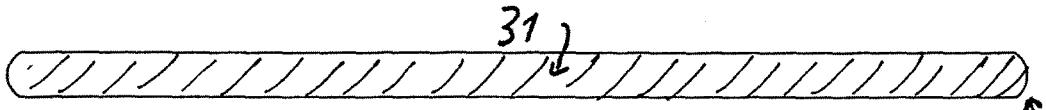
Figure 6B:
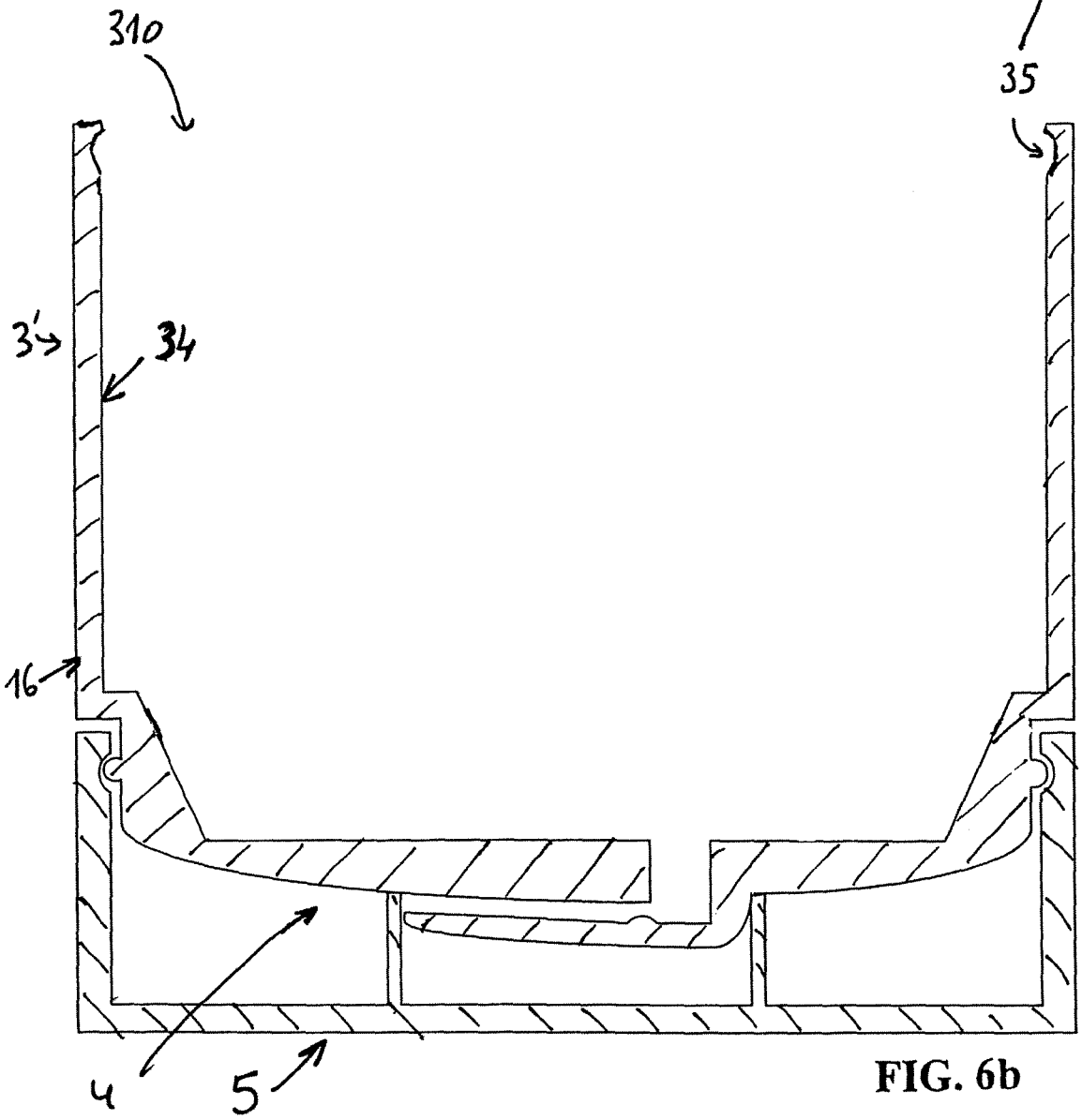

FIGS. 6*a* and 6*b* are axial cross sectional views that illustrate another embodiment of applicator distributor (1, 1'). In this embodiment, the reservoir (3) is a reservoir (3') whose base (31) as shown in FIG. 6*a*, may be clipped onto the skirt (34) of the reservoir (3), after said reservoir (3') has been filled by the base, via its opening (310).

FIG. 6*b*, analogous to FIG. 2*a*, shows the reservoir (3) forming with the distribution head (4) a one-piece molded part called the fourth one-piece molded part (16), forming with the cap (5) a "downward-facing" assembly ready to be filled via the base.

Figure 7A:
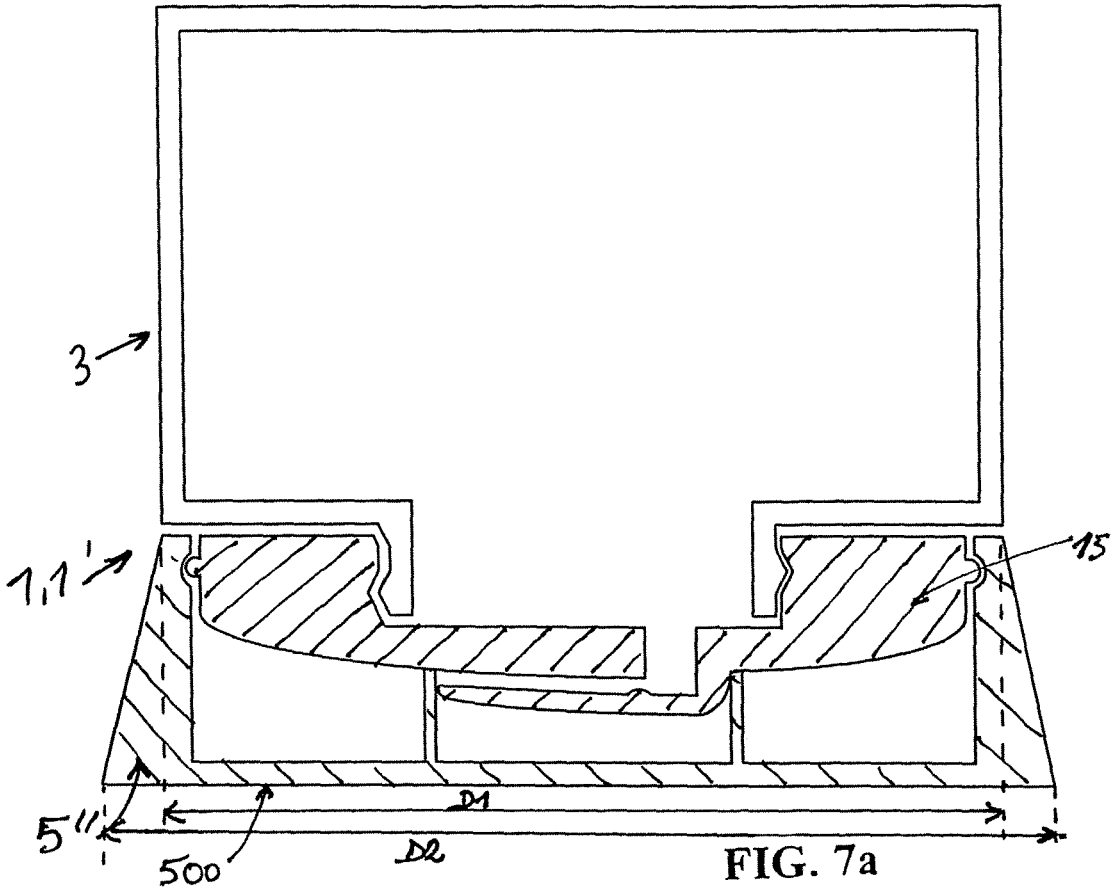

FIG. 7*a*, analogous to FIG. 2*a*, is distinguished from it in that said cap (5) is a cap (5") that has, on all or part of its axial height, a section that is greater than that of said body (2), typically of diameter D2>D1, especially so that it increases the stability of said vertical stationing, of the so-called "downward-facing" applicator distributor (1'), so that said product (6) is loaded on said secondary reservoir (44).

Figure 7B:
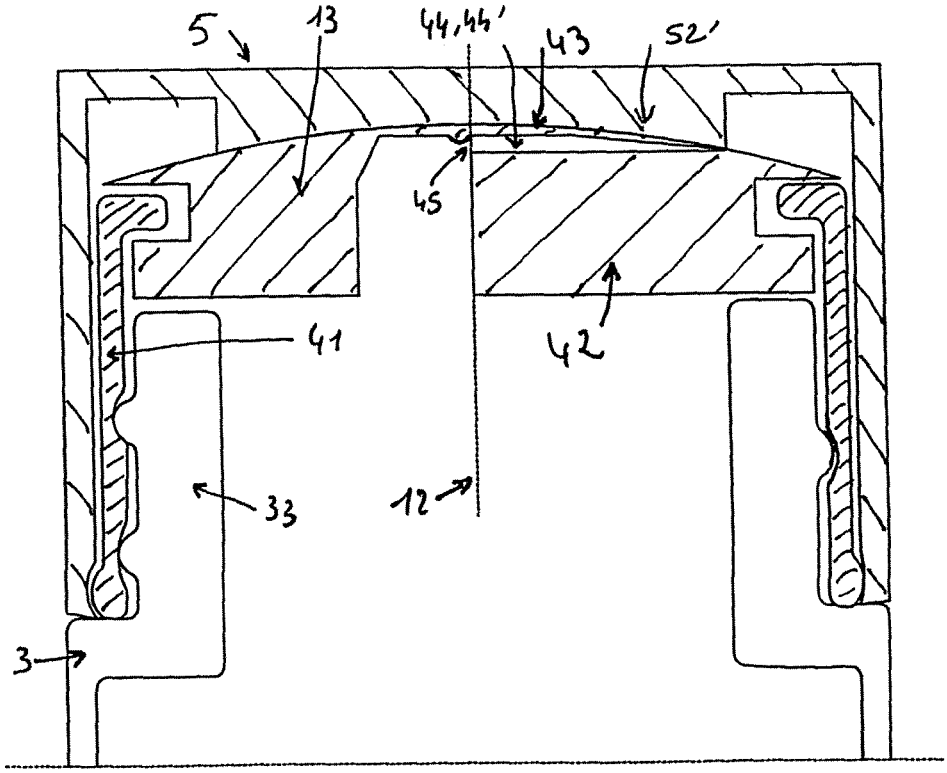

FIG. 7*b* is a partial axial cross sectional view (12) of another embodiment of the applicator distributor (1) shown closed and "facing upwards". In this embodiment, said central member (42) and said flexible member (43) form a one-piece molded part, called the first one-piece molded part (13), typically made of elastomer, attached to the spout (33) of said reservoir (3) by said peripheral member (41) forming a connecting ring.

FIGS. 8*a* to 8*d* are partial views analogous to FIG. 1*b*, which diagrammatically illustrate the operation of the applicator distributor (1, 1').

Figure 8A:
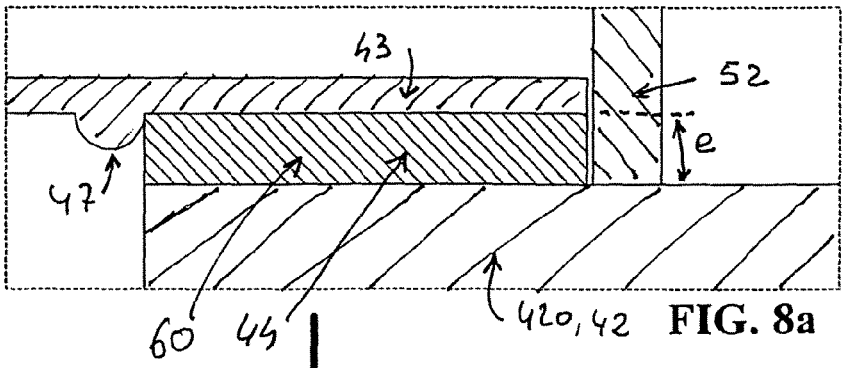

FIG. 8*a* shows the "upward-facing" applicator distributor (1, 1'), closed by the cap (5) and ready to be used. The secondary reservoir (44) of the distribution head (4) has a maximum capacity $C_M$ and is filled with a dose (60) of said product (6).

Figure 8B:
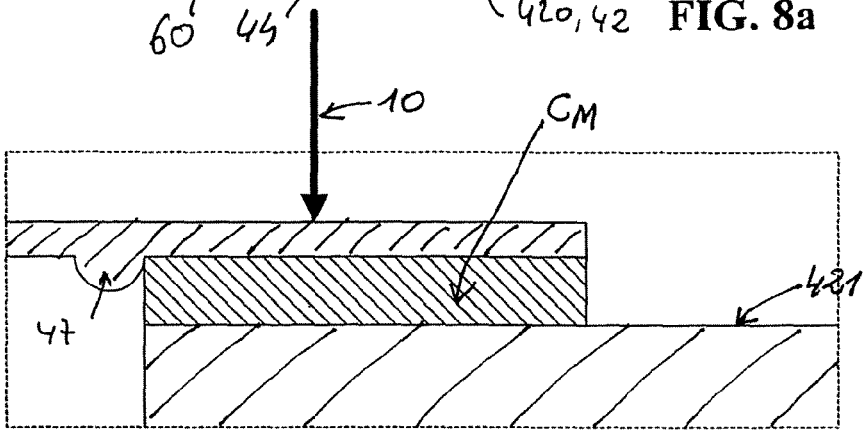

In FIG. 8*b*, the cap (5) has been removed and the axial strain (10) is on the point of being applied to the flexible member (43).

Figure 8C:
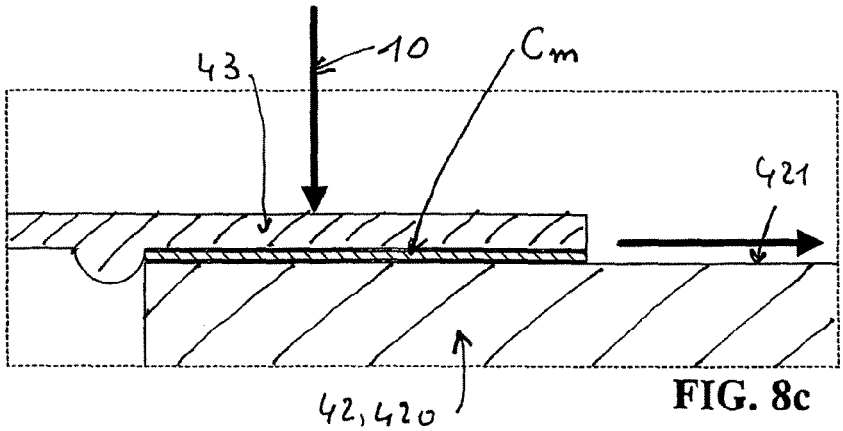

In FIG. 8*c*, the axial strain (10) has been applied to the flexible member (43), which has led to the expulsion of the dose (60) of said product towards the application surface (421), wherein said secondary reservoir (44) has the minimum capacity $C_m$, and wherein $C_m \ll C_M$.

Figure 8D:
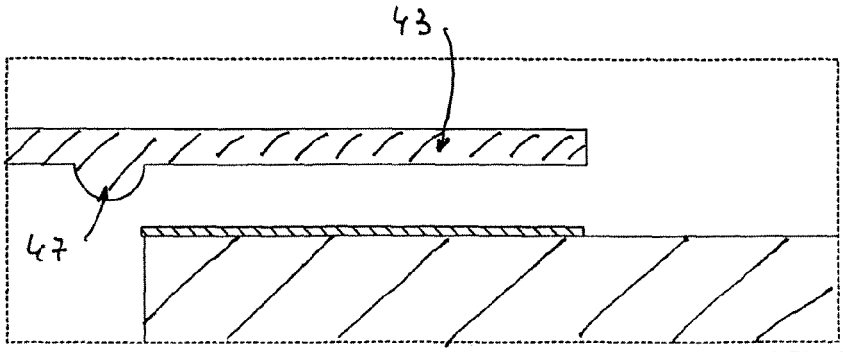

FIG. 8*d* shows the elastic recoil of the flexible member (43) to its initial position, wherein said axial strain (10) is no longer applied to said flexible member (43), wherein said empty secondary reservoir is ready to be filled again, as soon as said applicator distributor, typically equipped with its cap (5), is placed back in its downward-facing position.

The following is a key to reference numbers found in the various embodiments of aspects of the invention disclosed in the figures:

Applicator distributor . . . 1
Downward-facing applicator distributor . . . 1'
  Axial strain . . . 10
  Transverse plane . . . 11
  Axial direction . . . 12
First one-piece molded part . . . 13
Second one-piece molded part . . . 14
Third one-piece molded part . . . 15
Fourth one-piece molded part . . . 16
Cooperation means between 5 and 2 or 4 . . . 17
Body . . . 2
  Cooperation means between 3 and 4 . . . 20
Main reservoir . . . 3
  Main opening . . . 30
  Base . . . 31
    Filling opening of 3 . . . 310
  Sealing means of 310 . . . 32
  Spout . . . 33
  Skirt . . . 34
  Clipping means of 31 and 34 . . . 35
Distribution head . . . 4
  Distribution orifice . . . 40
  Peripheral element . . . 41
  Central element . . . 42
    Central arch . . . 420
    Application surface . . . 421
  Flexible element . . . 43
  Resilient flexible strip . . . 43'
  Transverse strip . . . 43"
    Central part . . . 430
    Peripheral part-lip . . . 431
    Contact lip . . . 431'
    Free lip . . . 431"
    End cooperating with 42 . . . 432, 432'
  Secondary reservoir . . . 44
  Secondary transverse reservoir . . . 44'

Upstream communication means . . . 45
Downstream communication means . . . 46
Downstream orifice . . . 460
Non-return projection . . . 47
Separate part formed by 43 . . . 48
Cap . . . 5.5', 5"
Upper wall . . . 50
Outside surface . . . 500
Skirt . . . 51
Axial projection of 50 . . . 5'
Product . . . 6
Dose of product . . . 60

DETAILED DESCRIPTION OF PREFERRED EMBODIMENTS OF THE INVENTION

In one embodiment of aspects of the invention, the flexible member (43) can form a resilient flexible strip (43'), so that, in the absence of axial strain (10), the secondary reservoir (44) has a maximum capacity $C_M$ which can typically range from 0.01 $cm^3$ to 1 $cm^3$. In an embodiment, the minimum capacity $C_m$ is less than approximately 0.2 $C_M$. In another embodiment, the minimum capacity $C_m$ is less than 0.1 $C_M$.

The flexible strip (43') may be a transverse strip (43") located in a plane that is substantially transverse (11) perpendicular to the axial direction (12) of said applicator distributor (1), so as to form a secondary transverse reservoir (44') whose axial thickness "e" can range from 0.2 mm to 3 mm. When said transverse strip (43") is moved away from said central member, said secondary reservoir can have its maximum capacity $C_M$.

In a first embodiment of the invention, and as illustrated in FIG. 7*b*, the flexible member (43, 43', 43") can form with said central member (42) a first one-piece molded part (13) made of plastic. The first molded part (13) can cooperate with said peripheral member (41), typically by axial clipping or a screw thread.

In a second embodiment of the invention, and as illustrated in the FIGS. 3*b* to 3*e*, said flexible member (43) can form a molded part (48), typically an elastomer, substantially cooperating with said central member (42) or said peripheral member (41) of said distribution head (4). In this embodiment, said peripheral member (41) and said central member (42) can form a second one-piece molded part (14) made of plastic. The second molded part (14) can cooperate with said flexible member (43, 43', 43"), typically by clipping, gluing or welding.

In a third embodiment of the invention, and as illustrated in FIGS. 1*a*, 4*a*, 5*a*, 5*b* and 7*a*, said peripheral member (41), said central member (42) and said flexible member (43, 43', 43") can form a third molded part made of plastic (15).

In a fourth embodiment of the invention, and as illustrated in FIGS. 6*a* and 6*b*, the reservoir (3) and said third molded part (15) can form a fourth one-piece molded part (16), wherein said reservoir (3) is a reservoir (3') comprising a base (31) equipped with a filling opening (310) via the base and sealing means (32) for said filling opening (310).

As illustrated for example in FIG. 1*a*, said peripheral member (41) and said main reservoir (3) can cooperate via a screw thread or axial clipping, typically via cooperation means (20).

As illustrated in FIGS. 1*b*, 1*c* and 8*a*, the flexible strip (43', 43") may comprise a central part (430) separated by axial thickness "e" from said central member (42). The central arch (420), and a peripheral part forming a lip (431) can permit expulsion of dose (60) of product (6), so as to form downstream communication means (46) when axial strain (10) is exerted on said flexible strip (43', 43").

As illustrated in FIG. 1*c*, lip (431) may be a contact lip (431') comprising one end (432) cooperating with central member (42), so as to obstruct said secondary reservoir (44) at its downstream part, wherein end (432) is moved away from central member (42) to allow dose (60) of product (6) to flow when axial strain (10) is exerted, so as to form downstream communication means (46).

As illustrated in FIG. 1*b*, lip (431) may be a free lip (431") comprising one end (439') distant from central member (49), typically distant by axial thickness "e," in the absence of axial strain (10), so as to form a downstream orifice (460) opening onto said application surface (421).

Regardless of the embodiment of the invention, cap (5') may comprise an upper wall (50) and a skirt (51) cooperating in a removable manner with body (2) when said applicator distributor (1) is said to be closed, typically via a screw thread or axial clipping, via cooperation means (17) as shown in FIG. 1*a*.

As illustrated in FIGS. 1*a*, 3*a*, 5*a*, 5*c*, 6*b*, 7*a*, upper wall (50) may comprise an axial projection (52) cooperating with said flexible member (43, 43', 43") when said applicator distributor (1) is said to be closed, so as to prevent or limit any risk of dose (60) of product (6) contained in said secondary reservoir (44) being expulsed towards said application surface (421). This projection (52) may be a massive projection (52') as illustrated in FIG. 7*b*.

In the invention, said cap (5'), and typically said axial projection (52), may cooperate with said body (2) and typically with said flexible member (43, 43', 43"), so as to ensure a substantially leak proof seal of said body (2) when said applicator distributor is closed.

In this way, and in this embodiment, any flow of said product out of said secondary reservoir (44, 44') can be made impossible when said distributor is in the downward-facing position, in order to carry out the automatic filling of said secondary reservoir (44, 44').

The flexible member (43, 43', 43") may be formed in elastomer. However, it is sufficient for said flexible member (43) to have a thickness thin enough to be able to use another plastic material, and for example a polyolefine, so as to have a strip that is both flexible under a relatively low axial strain (10), that can typically range from 0.5.N to 5.N, and that is resilient.

As illustrated in FIGS. 4*a* to 4*c*, distribution head (4) can comprise a plurality of N flexible elements (43, 43', 43"), typically spaced angularly around said axial direction at an angle equal to 360°/N. In some embodiments, N ranges from 2 to 5.

FIGS. 4*a* to 4*c* illustrate the case of a distribution head (4) comprising 4 flexible elements.

Advantageously, each of the N flexible elements can correspond to a different maximum capacity $C_{Mi}$, with i ranging from 1 to N, so as to have the choice between N different doses (60) for an application of said product.

As illustrated in these figures, flexible member (43, 43', 43") and central member (42) may have in an axial plane containing said axial direction (12), each with an external profile in the same axis as one another, said external profile typically forming a convex surface, as to make said product (6) easier to apply.

In aspects of an embodiment of the invention, cap (5) may be a cap (5') forming a means of vertical stationing of said applicator distributor (1), wherein said applicator distributor (1) is a so called downward-facing applicator distributor (1'), so that, when said applicator distributor (1') is closed and resting on any support, said cap (5') cooperating with said body (2), main opening (30) is then located at the lower part of main reservoir (3) so that product (6) can flow by gravity to said head (4) and up to said secondary reservoir (44).

The secondary reservoir (44), in an embodiment, may, in the case of an applicator distributor (1) resting facing upwards on a support, be refilled in one movement by tilting said applicator distributor from an "upward-facing" position to a "downward-facing" position, before each use, whereas said secondary reservoir (44) will be continuously filled with product in the case of a so-called downward-facing applicator distributor (1').

In this embodiment, and as illustrated in FIG. 2*a*, upper wall (50) of cap (6) may have a flat external surface (500) typically perpendicular to axial direction (12), so as to form means of vertical stationing of applicator distributor (1).

As illustrated in FIG. 7*a*, cap (5') may be a cap (5") that presents, on all or part of its axial height, a section greater than that of the body (2), in particular so as to increase the stability of vertical stationing of applicator distributor (1). It is thus possible to have a cap (5") with a diameter D2 greater than the diameter D1 of the body (2). In an embodiment, D2/D1 is at least equal to 1.1.

EXAMPLES OF EMBODIMENTS

In an embodiment, molding with thermoplastics and/or elastomers was used to make applicator distributors (1, 1') or parts of these applicator distributors (1, 1') shown in FIGS. 1*a* to 7*b*. These applicator distributors (1, 1') may, given the flatness of the external surface (500) of the upper wall (50) of the cap (5), be placed either facing upwards, or facing downwards on any support.

A first applicator distributor (1, 1') was made according to FIGS. 1*a*. 1*b*, 2*a*, 2*b*, by molding its component parts and assembling them by clipping. A variant of this first applicator distributor (1, 1') was also manufactured in which the means of FIG. 1*c* substituted the means of FIG. 1*b*. A body (2) of an applicator distributor (1, 1') was also made according to FIGS. 3*b* to 3*e*. A distribution head (4) was also made according to FIGS. 4*a* to 4*c*.

According to FIG. 5*c*, a variant of an applicator distributor (1, 1') according to FIG. 1*a* was also made. An applicator distributor (1, 1') according to FIGS. 6*a* and 6*b*, with filling via the base was also made. An applicator distributor (1, 1') according to FIG. 7*a*, equipped with a cap (5") of a relatively large cross section was also made. An applicator distributor (1, 1') according to FIG. 7*b* was also made.

The invention claimed is:

1. An applicator distributor for a pasty or viscous product, such as a cosmetic or hygiene product that can flow by gravity and can be spread when applied to a part of the human body such as the skin, comprising:

(a) a body comprising a main reservoir for said product equipped with a main opening, (b) a distribution head attached to said main reservoir, comprising at least one distribution orifice for said product, and (c) a removable cap cooperating with the body, wherein the distribution head further comprises:

(1) a peripheral member forming a means of attachment to the main reservoir, wherein the distribution head covers the main opening, (2) a central member comprising (a) a central arch obstructing the main opening and (b) a part forming an application surface of the product, and (3) at least one flexible element that may be deformed under an axial strain, wherein the flexible member cooperates with the central arch to form a secondary reservoir that can house one dose of the product, wherein the main reservoir is situated above the secondary reservoir when the applicator is facing in a downward direction, wherein the secondary reservoir can be filled when the applicator distributor is facing in a downward direction and the product flows by gravity from the main reservoir to the secondary reservoir by an upstream means of communication, wherein the upstream orifice is obstructed, the capacity of said secondary reservoir is reduced and the dose of the product is expulsed towards the application surface by a downstream means of communication when the axial strain is exerted on the flexible member, and wherein the reduction of the capacity of the secondary reservoir comprises a reduction in capacity from a maximum capacity $C_M$ to a minimum capacity $C_m$.

2. The applicator distributor of claim 1 wherein the flexible member comprises a resilient flexible strip wherein in the absence of the axial strain, the secondary reservoir has the maximum capacity $C_M$.

3. The applicator distributor of claim 2 wherein the resilient flexible strip is a transverse strip located in a substantially transverse plane perpendicular to an axial direction of the applicator distributor, wherein the transverse strip forms a portion of a secondary transverse reservoir of axial thickness "e" between approximately 0.2 mm and 3 mm, and wherein the secondary reservoir has its maximum capacity $C_M$ when the transverse strip is separated from the central member.

4. The applicator distributor of claim 2 in which the flexible strip comprises a central part separated by an axial thickness "e" from said central member, and a peripheral part forming a lip permitting the expulsion of the dose of said product so as to form said downstream communication means when said axial strain is exerted on said flexible strip.

5. The applicator distributor of claim 4 wherein the lip is a contact lip comprising one end cooperating with the central member, so as to obstruct the secondary reservoir at its downstream part, and wherein the one end moves away from the central member to allow the dose of product to flow when the axial strain is exerted, so as to form said downstream communication means.

6. The applicator distributor of claim 4 wherein the lip is a free lip comprising one end distant from the central member by the axial thickness "e", in the absence of the axial strain, so as to form a downstream orifice opening onto said application surface.

7. The applicator distributor of claim 1 wherein the flexible member and the central member form a first one-piece molded part made of plastic, and wherein the first molded part cooperates with the peripheral member via axial clipping or via screw thread.

8. The applicator distributor of claim 1 in which the flexible member forms a molded part comprised of an elastomer, cooperating with said central member or said peripheral member of said distribution head.

9. The applicator distributor of claim 8 wherein the peripheral member and the central member form a second one-piece molded part made of plastic, and the second molded part cooperates with the flexible member by clipping, gluing or welding.

10. The applicator distributor of claim 1 wherein the peripheral member, the central member and the flexible member form a third molded part comprising plastic.

11. The applicator distributor of claim 10 wherein the reservoir and the third molded part form a fourth one-piece molded part, wherein the reservoir is a reservoir comprising a base equipped with a filling opening via the base and sealing means for said filling opening.

12. The applicator distributor of claim 1 in which the peripheral member and the main reservoir cooperate via screw thread or axial clipping.

13. The applicator distributor of claim 1 wherein the cap comprises an upper wall and a skirt that cooperate in a removable manner with the body when the applicator distributor is closed via a screw thread or axial clipping.

14. The applicator distributor of claim 13 wherein the upper wall comprises an axial projection that cooperates with the flexible member when the applicator distributor is closed, so as to prevent any risk of the dose of the said product contained in the said secondary reservoir from being expulsed towards said application surface.

15. The applicator distributor of claim 14 wherein the cap, and the axial projection cooperate with the body and the flexible member so as to ensure a substantially leak proof seal of said body when the applicator distributor is closed.

16. The applicator distributor of claim 13, wherein the upper wall of the cap has a flat external surface perpendicular to the axial direction, so as to form the means of vertical stationing of the applicator distributor.

17. The applicator distributor of claim 16 wherein the cap comprises an upper section greater than that of the body which thereby increases the stability of the vertical stationing of said applicator distributor.

18. The applicator distributor of claim 1, wherein the flexible member is made of an elastomeric material.

19. The applicator distributor of claim 1, wherein the distribution head comprises a plurality of N flexible elements positioned angularly around the axial direction at an angle equal to 360°/N, with N ranging from 2 to 5.

20. The applicator distributor of claim 19 wherein each of the N flexible elements corresponds a different maximum capacity $C_{Mi}$, with i ranging from 1 to N.

21. The applicator distributor of claim 1 wherein the flexible member and the central member each have, in an axial plane containing said axial direction, an external profile extending in the same axis as one another, said external profile typically forming a convex surface, so as to make the product easier to apply.

22. The applicator distributor of claim 1 wherein the cap forms a means of vertical stationing of the applicator distributor, and wherein the applicator distributor is a downward-facing applicator distributor, so that when the applicator distributor is closed and resting on a support, the cap cooperates with the body and the main opening is situated at a lower part of the main reservoir so that the product can flow by gravity to the head.

* * * * *